US008904572B2

(12) United States Patent
Davis

(10) Patent No.: US 8,904,572 B2
(45) Date of Patent: Dec. 9, 2014

(54) TRIP LEVER ASSEMBLY

(75) Inventor: Robert Scott Davis, Grafton, WI (US)

(73) Assignee: Kohler Co., Kohler, WI (US)

( * ) Notice: Subject to any disclaimer, the term of this patent is extended or adjusted under 35 U.S.C. 154(b) by 124 days.

(21) Appl. No.: 13/300,000

(22) Filed: Nov. 18, 2011

(65) Prior Publication Data

US 2012/0124727 A1 May 24, 2012

Related U.S. Application Data

(60) Provisional application No. 61/415,543, filed on Nov. 19, 2010.

(51) Int. Cl.
*E03D 5/02* (2006.01)

(52) U.S. Cl.
CPC ..... *E03D 5/02* (2013.01)
USPC ..... 4/405; 4/324; 4/249

(58) Field of Classification Search
USPC ..... 4/249, 405, 324, 384
See application file for complete search history.

(56) References Cited

U.S. PATENT DOCUMENTS

| | | | |
|---|---|---|---|
| 1,334,173 | A | 3/1920 | Saal |
| 1,454,428 | A | 5/1923 | Curtin |
| 1,519,796 | A | 12/1924 | Pasman |
| 1,548,759 | A | 8/1925 | Shebwood |
| 1,555,620 | A | 9/1925 | Ayers et al. |
| 1,620,647 | A | 3/1927 | Griffiths |
| 1,902,758 | A | 3/1933 | Campbell |
| 2,295,686 | A | 9/1942 | Pleasant et al. |
| 2,487,315 | A | 11/1949 | Crampton |
| 2,609,564 | A | 9/1952 | Grimm |
| 3,406,408 | A | 10/1968 | Hudson |
| 3,419,912 | A | 1/1969 | Kertell |
| 3,426,365 | A | 2/1969 | Almont et al. |
| 3,518,703 | A | 7/1970 | Haldopoulos et al. |
| 3,539,234 | A | 11/1970 | Rapata |
| 3,795,016 | A | 3/1974 | Eastman |
| 3,922,713 | A | 11/1975 | Wheeler |
| 4,575,881 | A | 3/1986 | Rozek |
| 4,750,220 | A | 6/1988 | Baumann |
| 5,093,959 | A | 3/1992 | McTargett et al. |
| 5,400,445 | A | 3/1995 | Hull |
| 5,720,370 | A | 2/1998 | Takahashi |

(Continued)

FOREIGN PATENT DOCUMENTS

| | | |
|---|---|---|
| CN | 1367298 | 9/2002 |
| CN | 2890200 | 4/2007 |

OTHER PUBLICATIONS

First Office Action in related Chinese Application No. 201180055274.5 dated Jan. 28, 2014.

*Primary Examiner* — Huyen Le
*Assistant Examiner* — Erin Deery
(74) *Attorney, Agent, or Firm* — Foley & Lardner LLP

(57) ABSTRACT

An assembly for initiating flushing of a toilet includes a handle and a bushing. The handle includes an axially extending stem that defines an axis of rotation. The bushing is configured to rotatably couple the handle to a tank of the toilet and includes a passage with the stem of the handle received therein. The handle defines two or more annular handle surfaces that are configured to cooperatively engage two or more annular bushing surfaces for rotation of the handle relative to the bushing about the axis.

24 Claims, 6 Drawing Sheets

(56) References Cited

U.S. PATENT DOCUMENTS

| | | | |
|---|---|---|---|
| 5,819,330 | A | 10/1998 | Yokel |
| 5,918,324 | A | 7/1999 | Hwang et al. |
| 6,092,245 | A | 7/2000 | Jones |
| 6,393,624 | B1 | 5/2002 | Iwashita |
| 6,637,044 | B2 | 10/2003 | Rische et al. |
| 6,651,263 | B1 | 11/2003 | Hsiao et al. |
| 7,596,819 | B2 | 10/2009 | Dutton et al. |
| 2004/0175066 | A1 | 9/2004 | Chadwick et al. |

TRIP LEVER ASSEMBLY

CROSS-REFERENCE TO RELATED PATENT APPLICATION

The present application claims priority to and the benefit of U.S. Provisional Patent Application No. 61/415,543, filed Nov. 19, 2010, the disclosure of which is incorporated herein by reference in its entirety.

BACKGROUND

This disclosure relates to toilets and, more particularly, to trip lever assemblies for toilets.

In plumbing fixtures such as toilets, the flush cycle is usually initiated by rotating the position of a handle/trip lever on the outside of a toilet tank. Although the handle is external to the toilet tank, the handle is linked to a trip arm inside the water tank. When the handle is moved, a linkage inside the tank is actuated to pull/lift a chain or other linkage that is connected to a valve (e.g., a flapper valve or other type of valve) at the bottom of the tank. When the valve is unseated, water from the tank flows from the tank into the bowl to flush the toilet.

As one of the few parts of the toilet which a user contacts, the trip lever assembly plays a significant role in establishing the perceived quality of the toilet. Problems/deficiencies with respect to the trip lever assembly can give the user the impression that the overall fixture is low-budget or poorly constructed. For example, if the trip lever rattles, has a sloppy feel due to loose tolerances, or is too difficult to actuate, this reflects poorly on the user's impression of the entire toilet.

It would therefore be advantageous to provide an improved trip lever assembly to address deficiencies of this type.

SUMMARY

According to an exemplary embodiment, an assembly for initiating flushing of a toilet includes a handle and a bushing. The handle includes an axially extending stem that defines an axis of rotation. The bushing is configured to rotatably couple the handle to a tank of the toilet and includes a passage with the stem of the handle received therein. The handle defines at least two annular handle surfaces that are configured to cooperatively engage at least two annular bushing surfaces for rotation of the handle relative to the bushing about the axis.

According to an exemplary embodiment, an assembly for initiating a flush cycle of a toilet includes a bushing and a handle. The bushing is configured to be mounted through a wall of a tank of the toilet and includes a passage extending axially from an external end of the bushing to an internal end of the bushing. The handle includes a stem extending therefrom, which extends into the passage at the external end of the bushing and also defines a pivot axis of the handle. An external end race is positioned on the bushing proximate the external end, and an internal end race is positioned on the bushing proximate the internal end. When the handle is pivoted about the pivot axis to initiate the flush cycle, the handle separately bears on the external end race and the internal end race of the bushing.

According to an exemplary embodiment, a toilet includes a tank, a bowl, and an assembly for initiating flushing of the toilet. The tank includes a flush valve and is configured to contain water, while the flush valve is configured to open to release of water from the tank. The bowl is configured to receive water from the tank. The assembly for initiating flushing of a toilet includes a handle, a bushing, and a lever. The handle includes an axially extending stem that defines an axis of rotation. The bushing is configured to rotatably couple the handle to a tank of the toilet and includes a passage with the stem of the handle received therein. The handle defines at least two annular handle surfaces that are configured to cooperatively engage at least two annular bushing surfaces for rotation of the handle relative to the bushing about the axis. The lever is configured to rotate in unison with the handle and is operatively coupled to open the flush valve when the handle is rotated.

DETAILED DESCRIPTION

Figure 1:
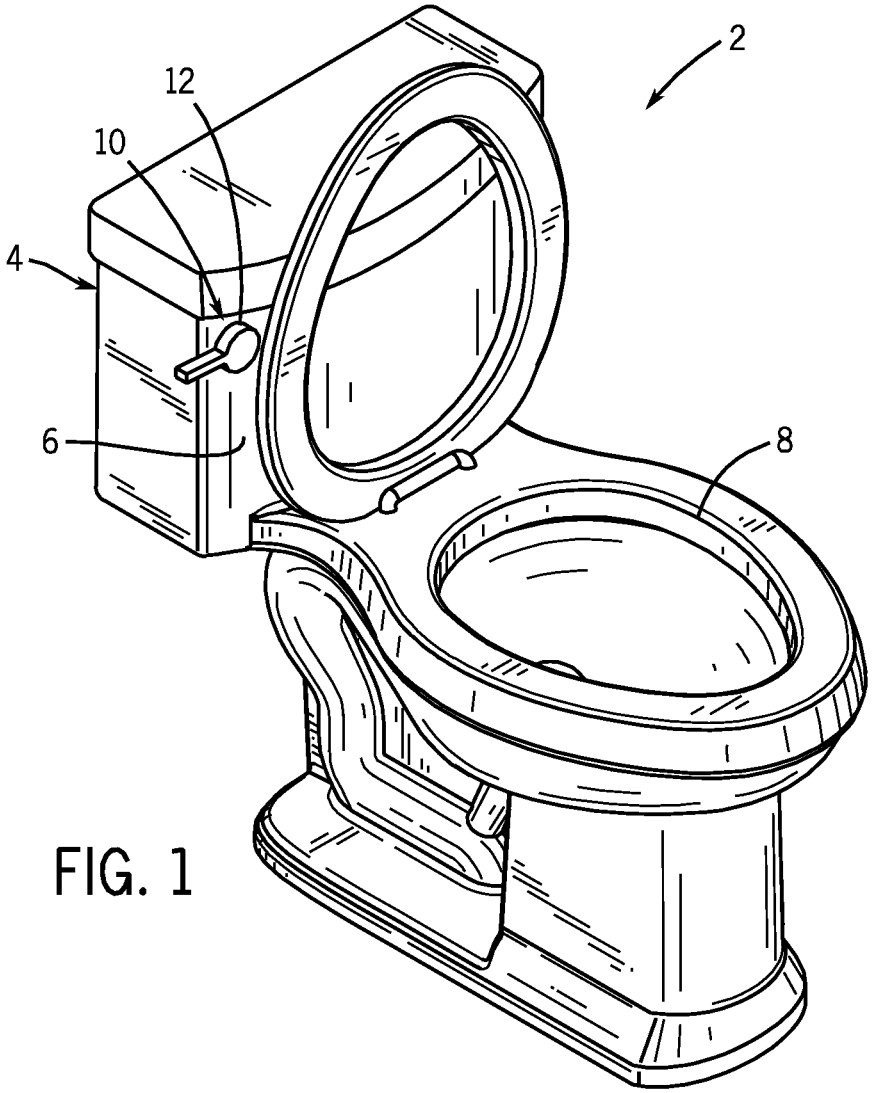
FIG. 1 is a perspective view of a toilet having trip lever assembly according to an exemplary embodiment.
Figure 2A:
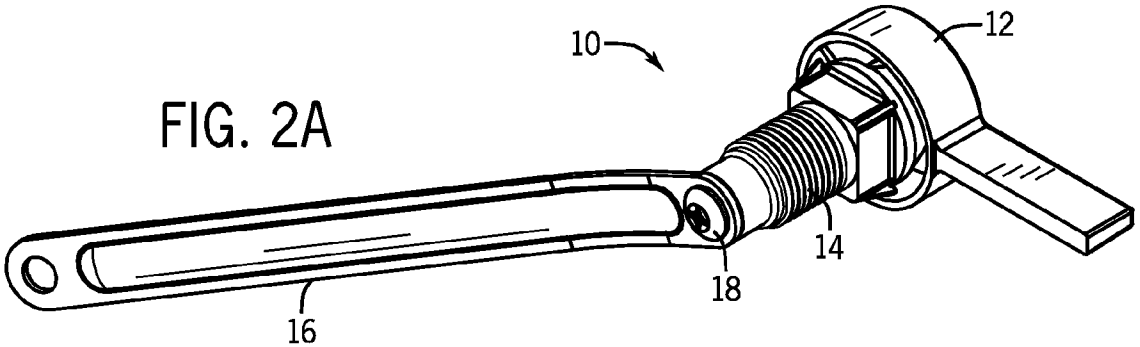
FIG. 2A is a perspective view of a trip lever assembly according to an exemplary embodiment.
Figure 2B:
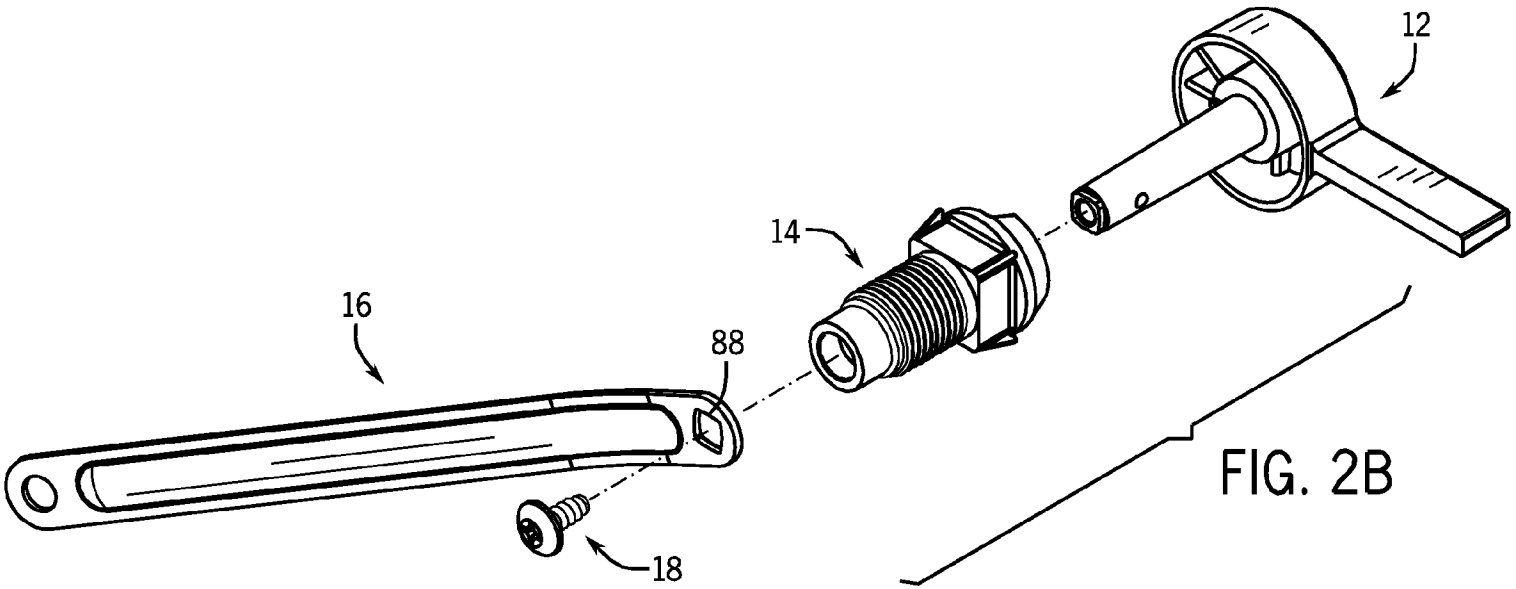
FIG. 2B is an exploded perspective view of the assembly of FIG. 2A.

Referring first to FIGS. 1, 2A, and 2B, a trip lever assembly 10 is shown that is intended for us in initiating a flush cycle of a toilet 2 according to an exemplary embodiment. The trip lever assembly 10 includes a handle 12, a bushing 14, a trip arm 16, and a fastener, such as a bolt 18. A trip lever assembly 10 of this type is installed through a wall 6 of a toilet tank 4 so that when the handle 12 is actuate (e.g., rotated), a flush cycle of the toilet is initiated (e.g., by moving a flush valve or flapper to release water from the tank 4 into a bowl 8 of the toilet 2). For example, the handle 12 is connected to the trip arm 16 by the bolt 18, with the handle 12 being arranged generally outside the toilet tank 4 and the trip arm 16 being arranged generally inside the tank 4. The bushing 14 rotatably couples the trip lever assembly 10, including the handle 12 and the trip arm 16, to the tank 4. When a user rotates the handle 12 (e.g., by pressing down on a trip lever 60 of the handle 12), the trip arm 16 rotates generally in unison with the handle 12 to pull on the flush valve to flush the toilet 2.

According to an exemplary embodiment, the handle 12 and bushing 14 are configured for cooperative engagement so as to rotatably couple the handle 12 to the tank 4 of the toilet 2. For example, in one aspect, the bushing 14 is fixedly coupled to the tank 4 and provides one or more bearing surfaces (e.g., annular bushing surfaces) that engage cooperative bearing surfaces (e.g., annular handle surfaces) of the handle 12, such that the handle 12 may rotate relative to the bushing 14 and, thereby, rotate relative to the tank 4. In another aspect, for example, the handle 12 and bushing 14 may include cooperative features that limit a range of rotation of the handle 12 relative to the bushing 14 and, thereby, limit rotation of the handle relative to the tank 4.

Figure 3:
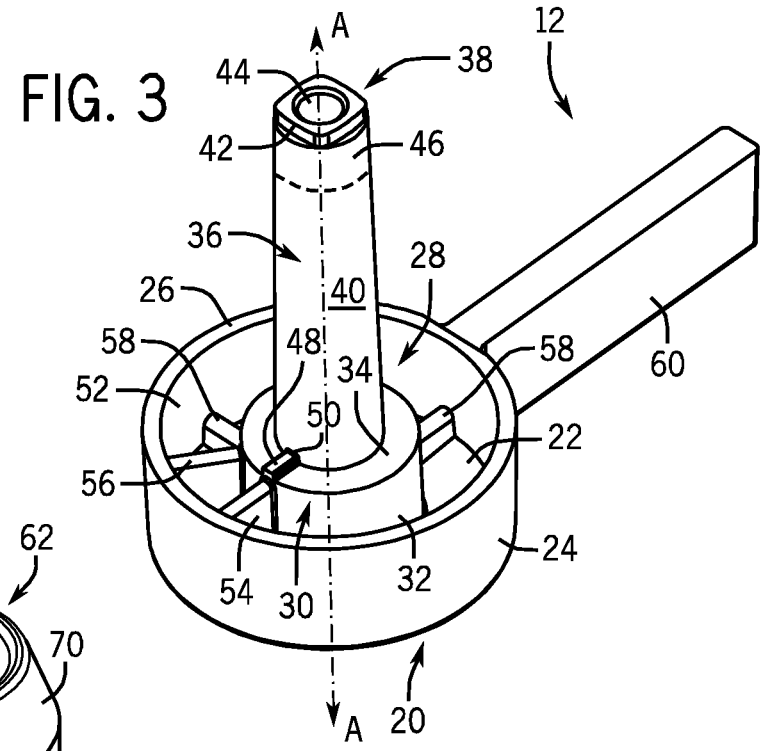
FIG. 3 is an enlarged perspective view of a handle of the assembly of FIG. 2A.
Figure 4:
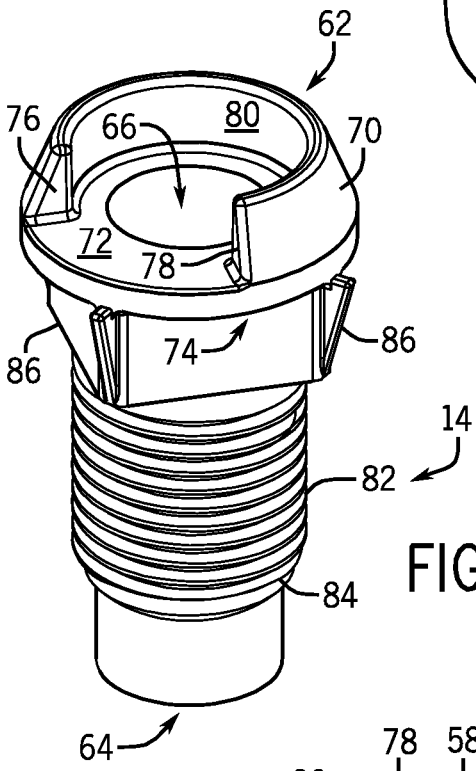
FIG. 4 is an enlarged perspective view of a bushing of the assembly of FIG. 2A.

With reference to FIG. 3, according to an exemplary embodiment, the handle 12 is centered around a hub 20. A stem 36 extends in a generally axial direction from the hub 20, and a trip lever 60 extends in a generally radial direction (e.g., perpendicular to the stem 36). The handle 12 is configured such that the trip lever 60 may be positioned external to the tank 4 for access by a user, while the stem 36 generally extends through the wall 6 of the tank 4 for connection to internal components of the toilet 2 (e.g., a flush valve), for example, by way of the trip arm 16.

According to an exemplary embodiment, the hub 20 and/or stem 36 may include various features for cooperatively engaging various complementary features of the bushing 14. For example, the hub 20 has a circular front wall 22 with a circumferential side wall 24 extending rearward from the circular front wall 22 to a rear lip 26. The circular front wall 22 and the circumferential side wall 24 define a cavity 28 on the back side of the hub 20. The cavity 28 on the rear side of the handle 12 houses, hides from view, and/or supports a number of structural features configured to interact with bushing 14 as described in more detail below. According to other exemplary embodiments, the hub 20 may be configured in other manners including, for example, by having a different shape (e.g., polygonal, oval, etc.), structure (e.g., generally solid, plate-like, different structural features, etc.), or by having other additional or different features based on various considerations that include, for example, desired aesthetic characteristics, functional characteristics, manufacturability, and/or cost.

According to an exemplary embodiment, among the features located in the cavity 28 is a central core 30, which is configured to cooperatively engage a second or external end race 80 of the bushing 14 (discussed in further detail below). The central core 30 is a generally cylindrical-shaped body that extends rearward from the circular front wall 22 into the cavity 28. The central core 30 includes a radially outward facing bearing or annular handle surface 32 and a rearward axially facing surface 34.

According to an exemplary embodiment, the stem 36 is configured to extend through a passage 66 of the bushing 14 and cooperatively engage a first or internal end race 68 of the bushing 14 (discussed in further detail below). The stem 36 extends generally perpendicular from the rearward axially facing surface 34 and projects along a pivotal axis A-A of the handle 12 to a distal end 38. The stem 36 has a radially outward facing surface 40 and, at the distal end 38, the stem 36 is adapted to connect to the trip arm 16 with a shaped periphery 42 and a threaded hole 44 (discussed in further detail below). According to some exemplary embodiments, the stem 36 may be considered to include the core 30 and its various features.

According to an exemplary embodiment, the central core 30 and the stem 36 include various features that define surfaces configured to bear on, or support a feature that bears on, the bushing 14 (e.g., the internal end race 68 and the external end race 80). The largest of these surfaces is the radially outward facing bearing surface 32 on the central core 30. Additionally, proximate the distal end 38 of the stem 36, the radially outward facing surface 40 of the stem 36 will provide another radially outward bearing or annular handle surface 46. The radially outward facing bearing surfaces 32 and 46 are co-axial with one another but are at different radial distances from the pivotal axis A-A. For example, the annular handle surfaces 32 and 46 may have diameters of approximately 15 mm (or approximately 0.6 in) and approximately 8 mm (or approximately 0.3 in), respectively, and widths of approximately 5 mm (or approximately 0.2 in) and 5 mm (or approximately 0.2 in), respectively. Further, the surfaces 32 and 46 may be spaced apart from each other by a distance of approximately 30 mm (or approximately 1.2 in). According to other exemplary embodiments, the surfaces 32 and 46 may be configured in other manners including, for example, by having a different shape (e.g., tapered or varied diameter), different size (e.g., larger or smaller diameter), different relative size, different widths (e.g., smaller or larger), or by being spaced apart a different distance (e.g., larger, smaller, or determined according to the thickness of the wall 6 of the tank 4).

According to an exemplary embodiment, various other bearing surfaces may be provided, for example, to control the relative axial positions of the handle 12 and the bushing 14. For example, still another bearing surface is found on a tab 48 positioned on the rearward axially facing surface 34 that runs between the base of the stem 36 and the outer edge of the central core 30. The tab 48 provides an axially facing bearing surface 50, albeit a bearing surface of small area.

According to an exemplary embodiment, the handle 12 is configured to cooperatively engage the bushing 14 to limit rotation of the handle 12. For example, the handle may include a number of ribs radially extend between the radially outward facing bearing surface 32 of the central core 30 and a radially inward facing surface 52 of the circumferential side wall 24. As best seen in FIG. 3, the ribs include a pair of radially extending stop members 54 and 56 which are spaced apart approximately 45 degrees and extend from the circular front wall 22 to the rearward axially facing surface 34. The stop members 54 and 56 are configured to engage ends 76 and 78 of a stop member 70 of the bushing 14 to limit rotation of the handle 12 relative to the bushing 14 (described in further detail below). The handle 12 may also include three shorter ribs 58 spaced 90 degrees apart from one another and one of the pair of radially extending stop members 54. These three shorter ribs 58 do not extend as far rearward as the pair of radially extending stop members 54 and 56 and primarily present to provide structural support.

According to an exemplary embodiment, the handle 12 further has a trip lever 60 that is configured to be accessed by a user for initiating flushing of the toilet 2. The trip lever 60 extends in a generally radial direction away from the hub 20. While in the form shown the trip lever 60 is straight and flat, the trip lever 60 could have other shapes or curvatures, for example, to ornamentally accent the design aesthetic of the rest of the toilet. According to an exemplary embodiment, the handle 12 may be configured in other manners including, for example, coupling the trip lever 60 directly to the stem (i.e., without an intermediate hub).

According to an exemplary embodiment, the handle 12 is configured as a unitary, injection molded plastic component. According to other exemplary embodiments, the handle 12 may include multiple pieces (e.g., a separate hub 20, stem 36, and trip lever 60) that are assembled together (e.g., with adhesive, fasteners, interference fit, etc., or combinations thereof). The handle 12 may also be made from different materials (e.g., metal, composites, natural materials, etc., or suitable combinations thereof) as determined according to functional considerations (e.g., strength, durability, manufacturability, cost, etc.) and/or aesthetic considerations (e.g., shape, size, surface finish, etc.), amongst various other considerations (e.g., tactile experience of a user).

According to an exemplary embodiment, the bushing 14 is configured to rotatably couple the handle 12 to the tank 4 of the toilet 2. For example, the bushing 14 may be configured to extend generally through the wall 6 of the tank 4 and provides one or more bearing surfaces for supporting the handle 12 and for enabling relative rotation therebetween.

According to one exemplary embodiment, the bushing 14 is a generally cylindrically shaped body extending from a second or external end 62 to a first or internal end 64 (as defined by the resultant placement of the bushing relative to the tank 4 of the toilet 2). A passage 66 extends axially through the body of the bushing 14 from the external end 62 of the bushing 14 to the internal end 64 of the bushing 14. The passage 66 is configured to receive the stem 36 of the handle therein (as described in further detail below). For example, the passage 66 is of a substantially constant diameter over most of its length, except for at the internal end 64 of the bushing 14 at which the passage 66 is narrowed to provide an internal end race 68 that faces radially inward (i.e., forms an annular bushing surface). For example, the diameter of the passage 66 may be approximately 11 mm (or approximately 0.44 in), while the diameter of the end race is approximately 8 mm (or approximately 0.3 in). According to other exemplary embodiments, the diameters of the passage 66 and end race 68 may be of a different size (e.g., smaller, larger, different relative sizes, or of constant or varying diameter).

According to an exemplary embodiment, the external end 62 of the bushing 14 is cooperatively configured with the handle 12 to define a limited range of rotation for the handle 12. For example, at the external end 62 of the bushing 14, the arcuate stop member 70 is formed on an axially facing surface 72 of a circular flanged portion 74 of the bushing 14. The arcuate stop member 70 extends angularly approximately 270 degrees about the central axis of the bushing 14 and has the pair of ends 76 and 78 located such that, when the handle 12 and the bushing 14 are assembled, the pair of ends 76 and 78 can coact with the pair of radially extending stop members 54 and 56 to define a range of rotation for the handle 12 relative to the bushing 14. As the arcuate stop member 70 extends approximately 270 degrees about the pivotal axis A-A and the pair of radially extending stop members 54 and 56 are spaced apart approximately 45 degrees, the total range of motion of the handle 12 relative to the bushing 14 will be approximately 45 degrees. According to other exemplary embodiments, the handle 12 and bushing 14 may be cooperatively configured in other manners including, for example, using different features (e.g., a tab and slot), inverting the features (e.g., different male/female relationship), and/or providing a greater or lesser range of motion (e.g., 90 degrees), etc. According to still other exemplary embodiments, rotation of the handle 12 may be limited in other manners including, for example, cooperatively engaging features of the stem 36 or trip arm 16 with the bushing 14.

According to an exemplary embodiment, the external end 62 is configured cooperatively with the handle 12 to enable relative rotation therebetween. For example, the external end 62 includes the external end race 80, which is configured to provide radial support to the central core 30 of the handle 12. The external end race 80 is also located on the arcuate stop member 70. The external end race 80 provides a surface (e.g., an annular bushing surface) that faces radially inward and is co-axial with the internal end race 68. The external end race 80 has a diameter of approximately 15 mm (or approximately 0.6 in) and is configured for receiving a portion of the central core 30 therein and for allowing relative rotation therebetween. Further, the external end race 80 may be larger than the diameter of the internal end race 68 found in the passage 66, the internal end race 68 being configured for receiving the annular handle surface 46 of the stem 36 and for allowing relative rotation therebetween. According to other exemplary embodiments, the external end race 62 may have a larger, smaller, or varying diameter.

According to an exemplary embodiment, the handle 12 and bushing 14 are cooperatively configured to limit axial movement therebetween. For example, in the form shown, the external end race 80 is of a greater diameter than the passage 66 running through the bushing 14 and so a portion of the axially facing surface 72 spaces the external end race 80 from the passage 66. For example, this may occur by generally engaging an axially facing surface 50 of a tab 48 in the cavity 28 (as discussed in further detail below).

According to an exemplary embodiment, the bushing 14 is also configured to generally rigidly couple to the tank 4 of the toilet 2, such as to maintain fixed axial and rotational positions of the bushing 14 relative to the tank 4 of the toilet 2. For example, the bushing 14 also has various features on its radially outward facing surfaces, such as threads 82 and a plurality of flexible crush ribs 86.

According to an exemplary embodiment, the threads 82 are found on a radially outward facing surface 84 of the bushing 14. When inserted into the wall 6 of the tank 4, these threads 82 will be located such that a nut 96 and/or washer 94 can be secured thereto. For example, after the bushing 14 is inserted into an aperture through the wall 6 of the tank 4, the nut 96 may be threaded to the threads 82 and tightened against an interior surface of the tank 4 so as to hold the bushing 14 generally in tension between the nut 96 and features (e.g., crush ribs 86 or the flange 74) of the external end 62 that engage an outer surface of the tank 4 in a generally opposite position. According to other exemplary embodiments, the bushing 14 may be configured in other manners for a fixed axial relationship with the tank 4, such as using other types of fasteners (e.g., pins, clips, etc.), an interference fit, and/or features for positive engagement (e.g., sprung tabs or clips).

According to an exemplary embodiment, the bushing 14 also includes a plurality of flexible crush ribs 86 between the circular flanged portion 74 at the external end 62 and the threads 82 located closer to the internal end 64. There are four crush ribs 86 which are angularly spaced 90 degrees apart from one another. The crush ribs 86 taper radially outward (at approximately 15 degrees from the central axis) as they extend from the threads 82 toward the circular flanged portion 74 and extend radially outward of the circular flanged portion 74 at the points at which the crush ribs 86 and the circular flanged portion 74 meet. Per FIG. 8, the crush ribs 86 are configured to be received in a square opening formed in the wall of the tank and to assist in establishing and maintaining the position (e.g., axial, translational, and/or rotational) of the bushing 14 in the wall. According to other exemplary embodiments, the crush ribs 86 may be configured in other manners including, for example, having a different number, spacing, shape, etc. According to still other exemplary embodiments, the bushing 14 may be configured with other features for maintaining axial and/or rotational positions relative to the tank 4, which may, for example, provide an interference and/or correspond to a tank opening having other shapes (e.g., square, polygonal, irregular, etc.).

According to an exemplary embodiment, the bushing 14 is preferably made of a Celcon M90-04 material which is designed to be injection moldable and has excellent wear resistance. According to other exemplary embodiments, the bushing 14 may be made in different manners including, for example, by using other manufacturing methods (e.g., machining, casting, etc.), by combining multiple parts to form the bushing 14 (i.e., a multi-piece assembly), and/or by using other suitable materials (e.g., other plastic materials, composites, metals, combinations thereof, etc.).

According to an exemplary embodiment, the trip lever assembly 10 includes a trip arm 16. The trip arm 16 is configured to rotate generally in unison with the handle 12 (e.g., when a user moves the handle 12), so as to initiate flushing of the toilet 2 (e.g., by lifting a flush or flapper valve of the toilet 2). The trip arm 16 may, for example, be an elongate structure coupled at a first end to the stem 36 of the handle 12 and coupled at a second end to the flush valve by a link (e.g., a chain, cable, bar, etc.). In order for the trip arm 16 to rotate with the handle 12, the stem 36 includes a shaped periphery 42 (e.g., a square) that serves as a male member to be received by a correspondingly shaped opening 88 of the trip arm 16. The stem 36 further includes a threaded hole 44 configured to receive the bolt 18 to hold the trip arm 16 in a fixed axial relationship relative to the distal end 38 of the stem 36. The trip arm 16 may, for example, be a unitary, stamped metal structure. According to other exemplary embodiments, the handle 12 and trip arm 16 may be configured in other manners including, for example, by having a different orientation (e.g., the trip lever 16 having a male member to be received by a female receptacle of the handle 12), by having different corresponding shapes (e.g., other polygonal, irregular, channels/ribs, slots, etc.), and/or by using different coupling methods (e.g., adhesives, other fasteners, interference fits, positive engagement features, peening or otherwise deforming the distal end 38 of the stem 36, etc.). According to still other exemplary embodiments, the handle 12 may be made from multiple pieces, be made according to other manufacturing methods (e.g., molding, machining, casting, etc.), or be made from one or more different materials suitable for use in a toilet tank environment.

Figure 5:
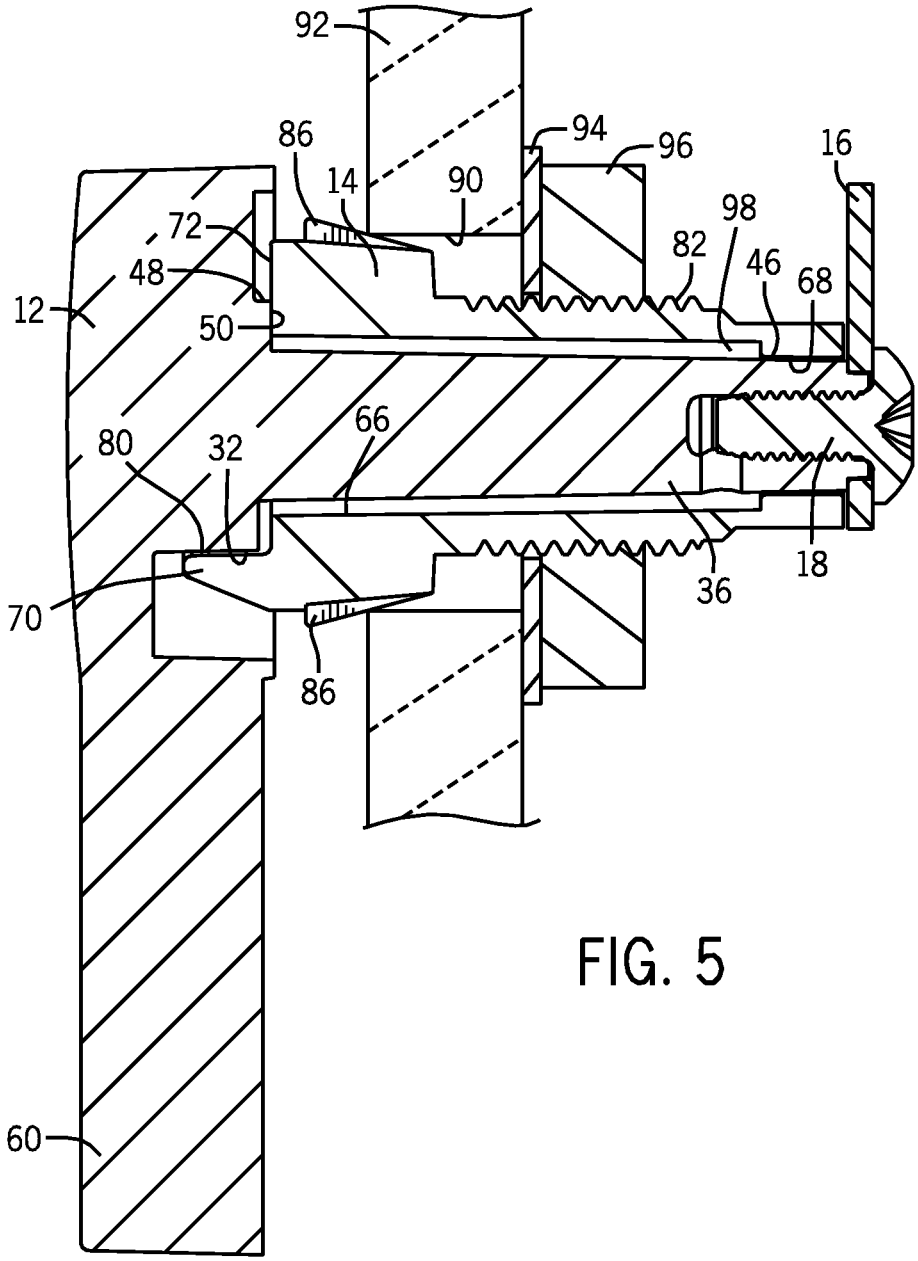
FIG. 5 is a partial cross-sectional view of the assembly of FIG. 2A in process of being inserted through an opening in a tank wall of a toilet.
Figure 6:
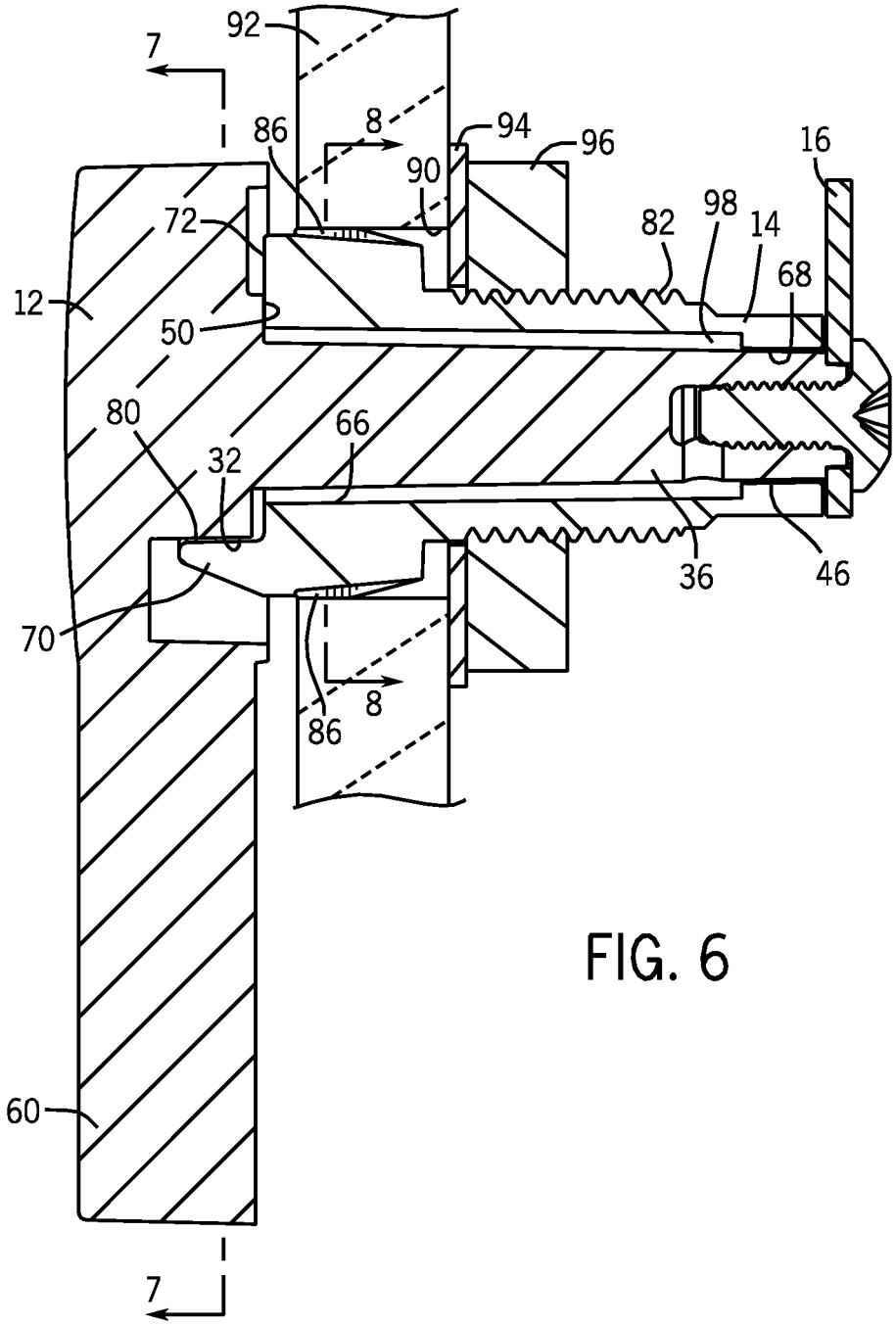
FIG. 6 is a partial cross-sectional view of the assembly of FIG. 2A fully inserted into the tank wall.

According to an exemplary embodiment, to assemble the trip lever assembly 10, the stem 36 of the handle 12 is inserted through the passage 66 of the bushing 14 such that the passage 66 is co-axial with the pivotal axis A-A of the handle 12. When the stem 36 is fully inserted into the passage 66 of the bushing 14, the arcuate stop member 70 is received into the cavity 28 of the handle 12, and the stem 36 extends all the way through the passage 66 of the bushing 14. Inserted in this manner, as best illustrated in FIGS. 5 and 6, the distal end 38 of the stem 36 projects slightly out of passage 66 at the internal end 64 of the bushing 14 for attachment to the trip arm 16. The shaped opening 88 formed at one end of the trip arm 16 is fit onto the shaped periphery 42 on the distal end 38 of the stem 36 and a fastener, such as the bolt 18, is inserted into the threaded hole 44 to rotationally lock the trip arm 16 to the handle 12. This attachment of the trip arm 16 to stem 36 also prevents the handle 12 from being axially withdrawn from the bushing 14. According to other exemplary embodiments, the trip lever assembly 10 may be assembled according to other methods as may be appropriate according to various considerations including, for example, various other designs of the trip lever assembly 10 and its subcomponents.

Figure 7:
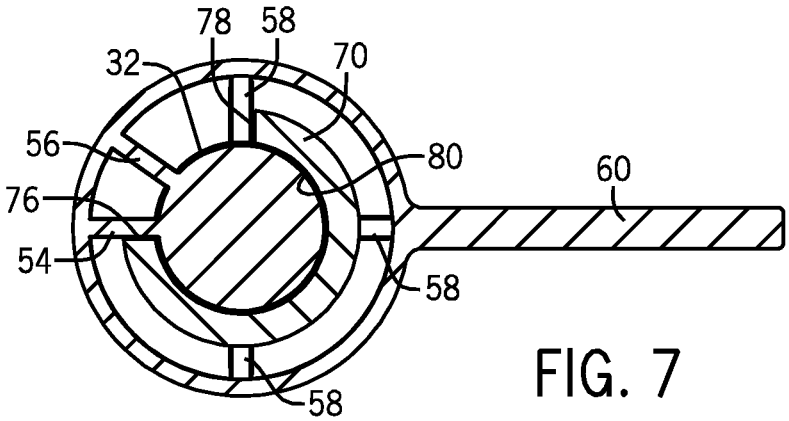
FIG. 7 is a cross-sectional view taken along line 7-7 of FIG. 6.

According to an exemplary embodiment, as best shown in FIGS. 5 through 7, when the trip lever assembly 10 is assembled, two pairs of bearing surfaces are established which are co-axial with one another. The first pair of bearing surfaces includes the radially outward facing bearing or annular handle 32 of the central core 30 of the handle 12 and the annular bushing surface provided by the external end race 80 on the arcuate stop member 70 of the bushing 14. The second pair of bearing surfaces includes the radially outward bearing or annular handle surface 46 of the distal end 38 of the stem 36 of the handle 12 and the annular bushing surface provided by the internal end race 68 in the passage 66 of the bushing 14. As referenced above, each pair of bearing surfaces is configured to allow relative rotation between the handle 12 and the bushing 14. For example, in the form shown, the first pair of bearing surfaces is engineered to have about 0.011 inches of space or tolerance therebetween, while the second pair of bearing surfaces are designed to have about 0.007 inches of space or tolerance therebetween. These tight tolerances minimize or reduce lateral movement of the handle 12 within the bushing 14. According to other exemplary embodiments, the handle 12 and bushing 14 may be cooperatively configured in other manners including, for example, by providing additional pairs of bearing surfaces, or by providing different tolerances.

Figure 8:
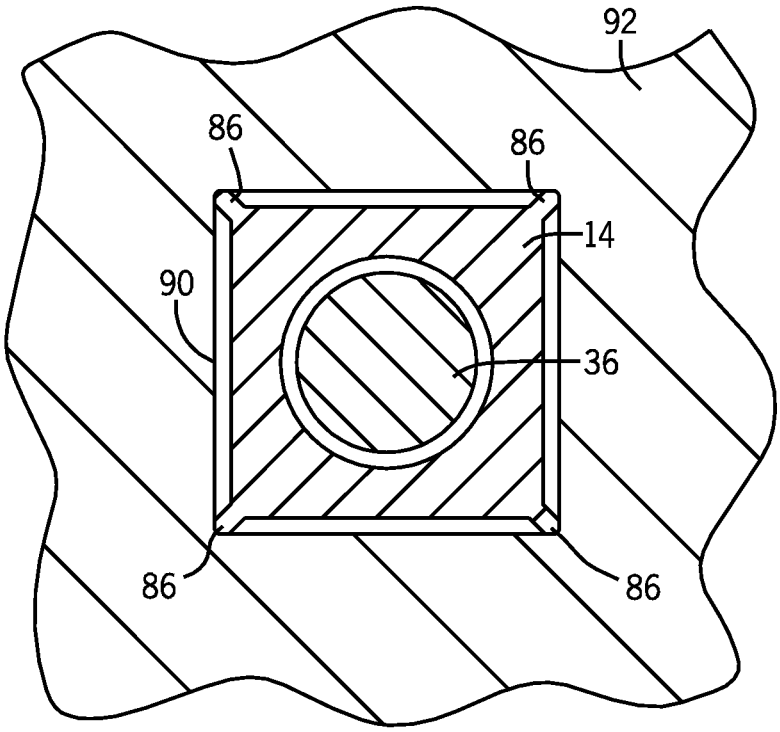
FIG. 8 is a cross-sectional view taken along line 8-8 of FIG. 6.

According to an exemplary embodiment, the portions of the stem 36 and passage 66 between the pairs of bearing surfaces are configured to have increased tolerance or clearance (e.g., gap 98) as compared to the bearing surfaces. For example, over the majority of the length of the passage 66 there is an ample amount of clearance (approximately 0.037 inches) between the stem 36 of the handle 12 and the inner surface of the passage 66 as depicted in FIG. 8. This means that the stem 36 does not contact the passage 66 between the internal end race 68 and the external end race 80. This clearance is advantageous because it allows for some deformation of the parts, and particularly a central area of the bushing having the threads 82 and the crush ribs 86, during the installation of the assembly 10 into the wall of the toilet without the increasing the force normal to the bearing surfaces. In contrast, if the passage 66 was to bear of the stem 36 and the bushing 14 was deformed, the force normal to the bearing surfaces would be increased, creating more resistance to rotation or irregular resistance to rotation of the handle 12 during flushing. According to other exemplary embodiments, the handle 12 and the bushing 14 are cooperatively configured in other manners to provide increased radial clearance between the stem 36 and the passage 66 including, for example, by increasing, decreasing, or otherwise varying the diameter of the passage 66 and/or the stem 36.

According to an exemplary embodiment, the bearing surfaces of each pair are configured to allow relative translational or sliding movement therebetween. For example, to provide smooth bearing surfaces the internal end race 68 and the external end race 80 are both polished surfaces. In other configurations a lubricant might be placed between the mating bearing surfaces. According to other exemplary embodiments, the handle 12 and bushing 14 are configured in still other manners to enable relative movement therebetween including, for example, selecting complementary materials or using other complementary shapes for the bearing surfaces (e.g., a partial round).

According to an exemplary embodiment, as referenced above, an additional bearing surface may be established between the axially facing bearing surface 50 of the tab 48 on the handle 12 and the axially facing surface 72 of the bushing 14. In some configurations, the tab 48 may be also be used to maintain the position of an insert positioned between the central core 30 and the arcuate stop member 70 that provides an interface between the two components with improved frictional qualities (e.g., a ring or other type of bushing). In some forms, this insert could also be made of Celcon, or other materials having complementary friction characteristics.

Turning to FIGS. 5 through 8, according to an exemplary embodiment, the assembly 10 is shown being installed in a square opening 90 of a wall 92 for a toilet tank. During typical installation, the bushing 14 is inserted through the square opening 90. As this happens, the four crush ribs 86 are directed to the four corners of the square opening 90 and may deform to some extent to position the bushing 14 with respect to the square opening 90. To help assist in forcing the bushing 14 into the square opening 90, a washer 94 and a nut 96 on the interior side of the tank and the nut 96 may be tightened on the threads 82 of the bushing 14 to draw the bushing 14 into place. When the nut 96 is sufficiently tightened, the circular flanged portion 74 (although not shown in the cross-sectional side views of FIGS. 5 and 6) will be drawn into contact with the front side of the wall 92. According to other exemplary embodiments, the trip lever assembly 10 may be installed in other manners such as may be appropriate for the other coupling features described above.

According to an exemplary embodiment, in the event that the bushing 14 is subject to rotational stresses, the crush ribs 86 will help to maintain the position of the bushing 14 in the square opening 90. For example, as the crush ribs 86 are positioned at the widest parts of the opening 90 (e.g., at corners of the opening 90), any rotational movement would increase the interference of the crush rib 86 with the wall 92. This causes the bushing 14 to seek the position with the least resistance, which is also the intended install position. According to other exemplary embodiments, the crush ribs 86 and/or opening 90 may be configured in other manners including, for example, a different number of ribs or a differently shaped opening.

Although FIGS. 5 and 6 depict the installation of the bushing 14 as occurring with the handle 12 and trip arm 16 already assembled, it will be readily appreciated by those having ordinary skill in the art that the bushing 14 could be first installed into the square opening 90 and then the other components assembled around the bushing 14.

The trip lever assembly includes relatively few components, but provides a well-constructed aesthetic. As the races on the bushing are spaced from one another and clearance may be provided between the stem and bushing between the races, the stem 36 of the handle 12 and/or the passage 66 of the bushing 14 may be deformed to some extent without creating additional resistance to rotation. The bushing may be produced with tight tolerance on the races which provide for smooth rotation and minimize lateral movement of the handle relative to the bushing. Further, the use of crush ribs can be used to locate the bushing with respect to the opening in the tank wall and prevent the bushing from becoming misaligned during use.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An assembly for initiating flushing of a toilet, the assembly comprising:

a handle having an axially extending stem that defines an axis of rotation; and a bushing configured to rotatably couple the handle to a tank of a toilet, the bushing having a passage with the stem of the handle received therein;

wherein the handle includes an outer annular handle surface that is configured to engage an outer annular bushing surface of the bushing and an inner annular handle surface that is configured to engage an inner annular bushing surface of the bushing;

wherein the outer annular handle surface is spaced apart axially from the inner annular handle surface, and the outer annular bushing surface is spaced apart from the inner annular bushing surface;

wherein a first tolerance is defined between the outer annular handle and bushing surfaces and a second tolerance is defined between the inner annular handle and bushing surfaces; and wherein a clearance is defined in a region between the outer annular handle and bushing surfaces and the inner annular handle and bushing surfaces, the clearance being greater than the first and second tolerances.

2. The assembly of claim 1, wherein the outer and inner annular handle surfaces are generally coaxial, and the outer and inner annular bushing surfaces are generally coaxial.

3. The assembly of claim 1, wherein a radius of the outer and inner annular handle surfaces are different, and a radius of the outer and inner annular bushing surfaces are different.

4. The assembly of claim 1, wherein a radius of the inner annular bushing surface is less than a radius of the outer annular bushing surface, the inner annular bushing surface is positioned generally within the passage, and the outer annular bushing surface is positioned generally outside the passage.

5. The assembly of claim 1, wherein the outer and inner annular handle surfaces are outward facing, and the outer and inner annular bushing surfaces are inward facing.

6. The assembly of claim 5, wherein the stem generally defines the inner and outer annular handle surfaces, the passage generally defines the inner annular bushing surface, and an arcuate member positioned external to the passage defines the outer annular bushing surface.

7. The assembly of claim 1, wherein the handle and the bushing are cooperatively configured to prevent rotation of the handle relative to the bushing in excess of 90 degrees.

8. The assembly of claim 1, wherein the bushing is configured to extend through an opening in a wall of the tank, a first end of the bushing being positioned generally interior to an outer surface the tank, and a second end of the bushing being positioned generally outside the tank; and wherein the inner annular bushing surface is positioned proximate the first end of the bushing, and the outer annular bushing surface is positioned outside the tank proximate the second end of the bushing.

9. The assembly of claim 8, wherein the bushing includes a plurality of ribs configured to engage the wall of the tank to prevent lateral and rotational movement between the bushing and the wall.

10. The assembly of claim 9, wherein the bushing includes a flange at the second end configured to engage the outer surface of the wall, and the bushing is configured to receive a fastener configured to engage an inner surface of the wall; and wherein the bushing is configured to be held in tension between the flange and the fastener.

11. The assembly of claim 10, wherein the plurality or ribs are configured to be drawn into the aperture by the fastener.

12. The assembly of claim 1 further comprising a lever, wherein the stem is coupled to the lever such that the lever rotates generally in unison with the stem, the lever is configured to be positioned within the tank, and the lever is configured to operatively couple to a flush valve.

13. The assembly of claim 1 wherein one of the inner and outer annular bushing surfaces extend about the axis less than 360 degrees.

14. The assembly of claim 13 wherein the one of the inner and outer annular bushing surfaces extends about the axis approximately 270 degrees.

15. An assembly for initiating a flush cycle of a toilet, the assembly comprising:

a bushing configured to be mounted through a wall of a tank of the toilet, the bushing having a passage extending axially from an external end of the bushing to an internal end of the bushing;

a handle having a stem extending therefrom, the stem extending into the passage at the external end of the bushing and defining a pivot axis of the handle;

an external end race positioned on the bushing proximate the external end; and an internal end race positioned on the bushing proximate the internal end;

wherein, when the handle is pivoted about the pivot axis to initiate the flush cycle, the handle separately bears on the external end race and the internal end race of the bushing;

wherein the stem does not contact the passage between the internal end race and the external end race.

16. The assembly of claim 15, wherein the external end race and the internal end race are both surfaces that face radially inward.

17. The assembly of claim 16, wherein the external end race and the internal end race are at different radial distances from the pivot axis.

18. The assembly of claim 16, wherein the bushing further comprises an arcuate stop member at the external end.

19. A toilet comprising:

a tank having a flush valve, the tank being configured to contain water and the flush valve being configured to open to release the water from the tank;

a bowl configured to receive water from the tank; and an assembly for initiating flushing of the toilet, the assembly comprising:

a handle having an axially extending stem that defines an axis of rotation;

a bushing configured to rotatably couple the handle to the tank of the toilet, the bushing having a passage with the stem of the handle received therein; and a lever configured to rotate in unison with the handle;

wherein the handle defines at least two annular handle surfaces that are configured to cooperatively engage at least two annular bushing surfaces of the bushing for rotation of the handle relative to the bushing about the axis; and wherein the lever is operatively coupled to open the flush valve when the handle is rotated;

wherein a first clearance is defined in a region between a first of the annular handle surfaces and a first of the annular bushing surfaces and a second clearance is defined in a region between a second of the annular handle surfaces and a second of the annular bushing surfaces;

wherein the clearances are configured to allow for deformation of at least one of the bushing and the handle.

20. The toilet of claim 19, wherein the first of the annular handle surfaces is generally coaxial with the second of the annular handle surfaces, and the first of the annular bushing surfaces is generally coaxial with a second of the annular bushing surfaces.

21. The assembly of claim 19, wherein the first of the annular handle surfaces is spaced apart axially from the second of the annular handle surfaces, and the first of the annular bushing surfaces is spaced apart axially from the second of the annular bushing surfaces.

22. The assembly of claim 21, wherein in a region between the first and second pair of bearing surfaces, a clearance between the stem and the passage is greater than the first tolerance and the second tolerance.

23. The assembly of claim 19, wherein a radius of the first annular handle surface is different from a radius of the second annular handle surface, and a radius of the first annular bushing surface is different from a radius of the second annular bushing surface.

24. The assembly of claim 19, wherein the bushing is configured to extend through an opening in a wall of the tank, a first end of the bushing being positioned generally interior to an outer surface the tank, and a second end of the bushing being positioned generally outside the tank; and wherein the first annular bushing surface is positioned proximate the first end of the bushing, and the second annular bushing surface is positioned outside the tank proximate the second end of the bushing.

* * * * *